United States Patent [19]

Guisinger

[11] Patent Number: 5,030,887

[45] Date of Patent: Jul. 9, 1991

[54] HIGH FREQUENCY FLUORESCENT LAMP EXCITER

[76] Inventor: John E. Guisinger, 19955 NW. Dairy Creek Rd., Cornelius, Oreg. 97113

[21] Appl. No.: 471,784

[22] Filed: Jan. 29, 1990

[51] Int. Cl.[5] ..... H05B 37/00

[52] U.S. Cl. ..... 315/158; 315/307; 315/DIG. 4; 315/DIG. 7

[58] Field of Search ..... 315/156, 157, 158, 209 R, 315/224, 291, 307, DIG. 4, DIG. 7

[56] References Cited

U.S. PATENT DOCUMENTS

| | | | |
|---|---|---|---|
| 3,936,696 | 2/1976 | Gray | 315/210 |
| 4,127,795 | 11/1978 | Knoll | 315/210 |
| 4,210,846 | 7/1980 | Capewell | 315/121 |
| 4,358,716 | 11/1982 | Cordes et al. | 315/306 |
| 4,368,406 | 1/1983 | Kruzich et al. | 315/158 |
| 4,388,567 | 6/1983 | Yamazaki et al. | 315/291 |
| 4,464,606 | 8/1984 | Kane | 315/158 |
| 4,523,128 | 6/1985 | Stamm et al. | 315/291 |
| 4,523,131 | 6/1985 | Zansky | 315/307 |
| 4,686,427 | 8/1987 | Burke | 315/219 |
| 4,697,122 | 8/1987 | Hoffer | 315/158 |
| 4,700,113 | 10/1987 | Stupp et al. | 315/224 |
| 4,704,563 | 11/1987 | Hussey | 315/307 |
| 4,716,343 | 12/1987 | Lindquist | 315/307 |
| 4,745,342 | 5/1988 | Andresen | 315/200 R |
| 4,749,917 | 6/1988 | Angott et al. | 315/307 |
| 4,766,350 | 8/1988 | Husgen et al. | 315/207 |

OTHER PUBLICATIONS

Thomas P. Kohler, "Integrated Circuit Control for Two-Lamp Ballast; Final Report", Lawrence Berkeley Laboratory, Nov. 1982.

Frank Goodenough, "PWM Controller Chip Fixes Power Factor", Electronic Design, Jun. 8, 1989, pp. 81-82, 84.

Bernard C. Cole, "Breaking the Power Factor Bottleneck", Electronics, Jul. 1989, pp. 83, 84.

*Primary Examiner*—Robert J. Pascal

*Attorney, Agent, or Firm*—Dellett, Smith-Hill and Bedell

[57] ABSTRACT

An electronic ballast for fluorescent lights is disclosed which includes a pulse width modulation driven inverter with feedback current controlling the pulse width. Ambient light feedback control is provided. The ballast includes a power factor correction pre-regulator for ensuring a high power factor. A pre-heat delay timer allows lamps cathodes to heat before applying driving voltage across the lamps.

12 Claims, 3 Drawing Sheets

HIGH FREQUENCY FLUORESCENT LAMP EXCITER

BACKGROUND OF THE INVENTION

The present invention relates to fluorescent lighting and more particularly to electronic fluorescent lighting ballast circuitry.

Modern fluorescent lamp circuits use solid state ballasts. U.S. Pat. No. 4,686,427 issued to Burke discloses an example of a typical solid state ballast circuit which converts AC line voltage into DC and then applies pulses to the lamps at a high frequency for eliminating lamp flicker and hum.

While early fluorescent lamps were operated at 60 Hz, a higher frequency of operation is desirable because as the operation frequency increases, the efficiency of the lamps also increases. The higher operation frequency can also lead to smaller and lighter weight components in the ballast circuitry and a steadier light output.

By itself, a fluorescent lamp is inherently a high-power-factor device but its ballast exhibits a low-power-factor. Thus, since a single-lamp circuit may have a power factor on the order of 50%, power factor correction is desirable. Without power factor correction load current will be out of phase with the line voltage and therefore, to produce a certain amount of light, the circuit must draw additional current from the power line. For example, a circuit operating at 115 volts to produce 1200 watts of power would apparently require approximately 10.4 amps of current. However, with a power factor of, for example, 65%, the circuit would draw approximately 16 amps to produce the same amount of work. Thus, wiring and circuit breakers in the lighting system would have to be of larger size than if the system had a higher power factor. Present day fluorescent lamp ballast circuits typically include components for power factor correction. Such components will, for example, comprise the addition of capacitance to bring the voltage and current closer into phase. A disadvantage to the sole use of these components is that the size, cost and weight of additional circuitry can be relatively large. In addition, the power factor correction achieved may not be as large as desired.

Lamp control circuits have used lamp light output as an indicator of lamp current. This use of light output may not result in accurate lamp current control since, for example, hot cathode fluorescent lamp light output at a given current is dependent upon air temperature surrounding the lamp. For example, a hot cathode lamp with a given current flow will produce approximately 70% of the light at 30° F. that the lamp would emit if the temperature were 80° F. Therefore, employing light output as an indicator of current can lead to excessive lamp current. Other circuits use a measure of current flow in the primary of a lamp driver circuit as an indicator of actual lamp current. However, this method does not provide a true representation of the current flowing through the lamps. Still other ballast circuits employ additional transformer windings or even separate transformers in the lamp circuit to monitor current flow. It would be desirable to measure the actual current flow through the lamps and adjust the lamp drive current based on that measurement without the need for transformers.

SUMMARY OF THE INVENTION

In accordance with the present invention, in a particular embodiment thereof, an electronic ballast circuit for fluorescent lamps includes a power factor correction pre-regulator to provide near unity power factor. An embodiment of the invention further includes a lamp current feedback system wherein lamp current is measured through the use of an opto-isolator and this information is used to control lamp current. The circuit can also adjust lamp brightness based on input from an ambient light level sensor or a manual control.

It is accordingly an object of the present invention to provide an improved electronic fluorescent lamp ballast circuit.

It is another object of the present invention to provide an improved lamp ballast circuit which employs lamp current feedback to limit lamp current rather than depending on passive components for this purpose.

It is another object of the present invention to provide an improved fluorescent lamp ballast system that is relatively immune to brown-out power conditions.

Another object of the present invention is to provide an improved lamp ballast circuit with lamp brightness feedback.

It is still another object of the present invention to provide an improved lamp ballast circuit with improved power factor correction.

The subject matter which I regard as my invention is particularly pointed out and distinctly claimed in the concluding portion of this specification. The invention, however, both as to organization and method of operation, together with further advantages and objects thereof. may best be understood by reference to the following description taken in connection with the accompanying drawings wherein like reference characters refer to like elements.

DRAWINGS

DETAILED DESCRIPTION

Figure 1:
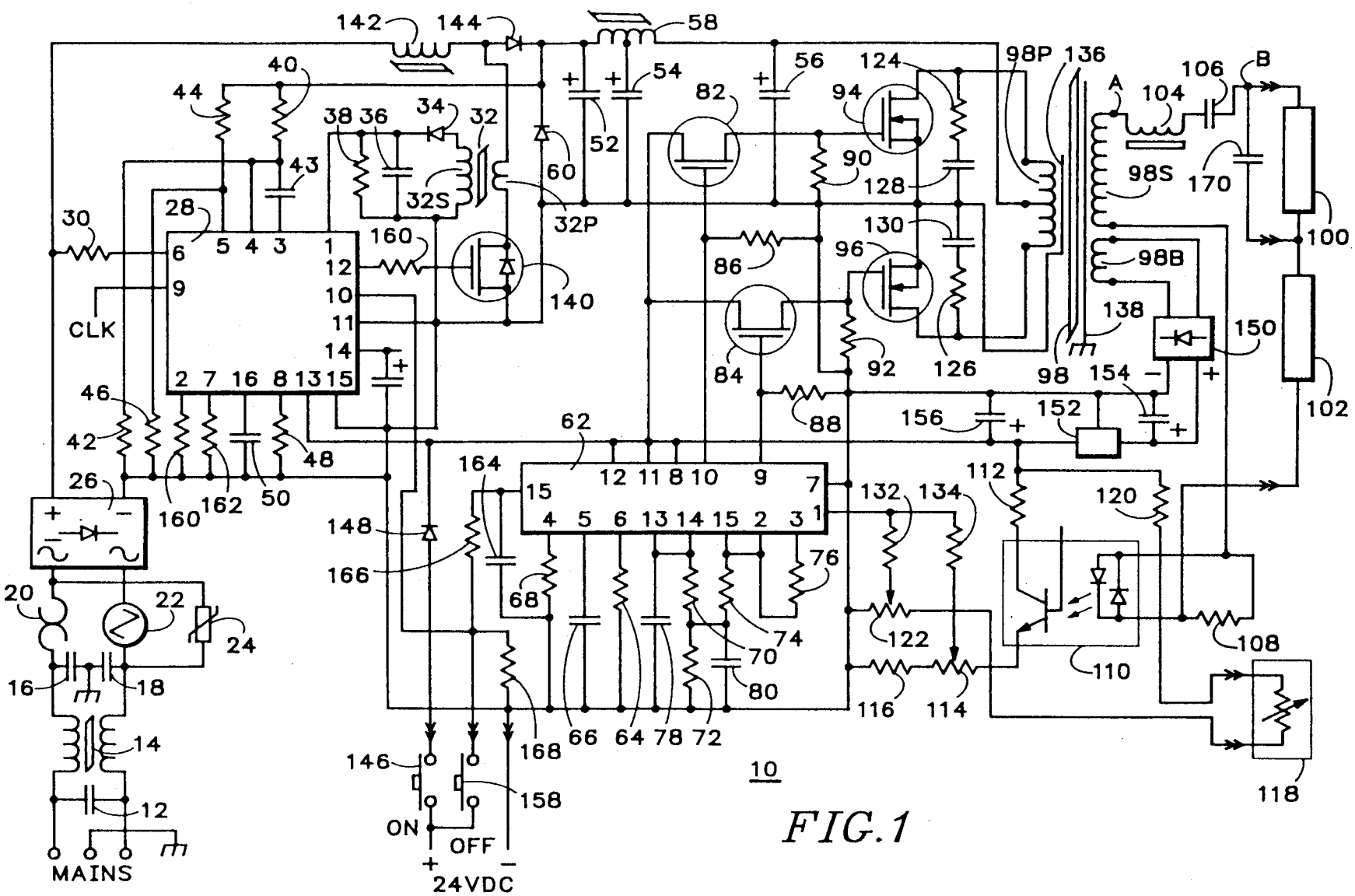
FIG. 1 is a schematic diagram of a preferred embodiment of the present invention.

Referring to FIG. 1, in the illustrated embodiment a high frequency fluorescent lamp exciter 10 includes a capacitor 12 connected across the AC input mains before coil 14, coil 14 having two windings connected in series with the AC mains, and capacitors 16 and 18, each connected between opposite legs of the AC input lines and ground on the load side of coil 14, together constituting a high frequency filter to prevent high frequency noise from returning from the circuit to the main supply. Additionally, a guard shield 136 of main transformer 98 discussed in more detail hereinbelow is tied to the main negative DC supply to aid in noise reduction, while another shield 138 is tied to earth ground to also minimize noise problems. Both shields 136 and 138 reduce the primary to secondary winding capacitance and primary capacitance to ground in the transformer.

A thermal switch 20 in one leg of the AC mains following coil 14 prevents damage due to over-temperature conditions, and a negative temperature coefficient resistor 22 serially interposed in one leg of the AC mains opposite thermal switch 20 limits initial inrush current. Varistor 24 shunted across the AC mains adjacent thermal switch 20 and resistor 22 is employed for clipping high voltage line transients to prevent damage to the lamp exciter 10 due to over-voltage. Bridge rectifier 26 which has an input connected to the output terminals of components 20 and 22 converts the alternating current from the main supply to direct current for application to power factor correcting pre-regulator circuit 28. In a preferred embodiment of the present invention circuit 28 comprises an ML4812 power-factor correction IC manufactured by Micro Linear Corp. of San Jose, California.

In the preferred embodiment, power factor correcting pre-regulator IC 28 provides an output of 380 volts DC at the cathode of diode 144 when AC mains inputs are between 90 and 260 volts rms. The anode of diode 144 is connected to the positive output of rectifier 26 through an inductor 142. Controller IC 28 is essentially a current mode switching regulator that is pulse width modulated and connected in a boost configuration. It senses the instantaneous value of the fully rectified voltage at rectifier 26 through resistor 30, disposed between the positive output of rectifier 26 and pin 6 of the controller, as a current ($I_{sine}$). Also, current transformer 32 has its primary 32P connected to the anode of diode 144 and provides a current reference for IC 28 at pin 1 via diode 34 in series between one leg of the secondary 32S of the transformer 32 and pin 1. Filter capacitor 36 and parallel burden resistor 38 are disposed between the cathode of diode 34 and the other leg of the secondary 32S which is returned to the negative output of rectifier 26 hereinafter referred to as the power ground. A resistor 40 is connected to the cathode of diode 144 and in series with a resistor 42 to the power ground, wherein the junction between resistors 40 and 42 is further connected to pin 4 of IC 28 and in series with a capacitor 43 to pin 3 of IC 28. A fraction of the output voltage at the cathode of diode 144 is thereby fed back from the voltage divider and shunted by filter capacitor 43. A second voltage divider between the cathode of diode 144 and power ground comprising resistors 44 and 46 provides over-voltage sensing at pin 5 of IC 28.

IC 28 includes an internal oscillator having a frequency of operation which is set via selection of resistor 48 and capacitor 50 connected between pins 8 and 16 respectively of IC 28 and power ground. The frequency of operation in an exemplary embodiment was 100 kHz. Resistors 160 and 162, connected between pins 2 and 7 of IC 28 and the power ground, determine the current ramp and reference voltage internally of controller IC 28.

Connected in parallel between the cathode of diode 144 and the power ground are a diode 60 and a capacitor 52. Choke 58 couples the cathode of diode 144 to one terminal of a capacitor 56, returned to power ground, while a capacitor 54 is interposed between ground level and the center tap of the choke. Capacitors 52, 54 and 56 and choke 58, as well as free wheeling diode 60 connected across the circuit to allow for current flow through choke 58 during the low voltage portion of the input voltage waveform, provide a pseudo constant current source to the primary center tap of main transformer 98 to aid in power factor correction. Use of IC 28 allows the values of capacitors 52, 54 and 56 and choke 58 to be reduced from what might otherwise be required, in part since a signal of much higher frequency than 60 Hz is being filtered (e.g. in a preferred embodiment, 100 kHz). Thus, component cost is reduced as well as weight and space requirements. Almost pure DC with no ripple is supplied following choke 58.

A MOSFET 140 is employed in conjunction with controller IC 28, with the drain of the MOSFET providing the return of primary 32P of transformer 32, while the source of MOSFET 140 is connected to power ground. The gate of MOSFET 140 is connected to pin 12 of IC 28, comprising the pulse width modulation output, through resistor 160. In operation, controller IC 28 and MOSFET 140 are initially off. When a new cycle of the internal oscillator of IC 28 is started, a pulse width modulation output is applied to the gate of MOSFET 140 through resistor 160, turning MOSFET 140 on and thereby initiating a current ramp through inductor 142. When the current in inductor 142, as monitored through current transformer 32, is proportional to the line voltage, IC 28 forces the voltage at the pulse-width modulation output IC (pin 12 of IC 28) to go low, thus turning MOSFET 140 off. Flyback voltage from inductor 142 at the anode of diode 144 is positive by an amount exceeding the rectified value of input. The flyback voltage is rectified by diode 144 and charges capacitors 52, 54 and 56 to a higher value, ultimately to 380 volts DC.

To achieve high power factor, the input current waveform is modified to follow the phase and shape of the input voltage waveform at the output of rectifier 26. If the internal oscillator of IC 28 is running at 100 kHz, the line current is sampled and set to match the line voltage in phase and shape more than 800 times each half cycle of the AC input.

The present invention further employs an integrated circuit 62 which comprises a pulse width modulator of fixed frequency. In a preferred embodiment of the invention IC 62 comprises a TL494 pulse width modulation control IC manufactured by Texas Instruments Inc. The modulation frequency is set by resistor 64 and capacitor 66 which are connected between the power ground and pins 6 and 5 of IC 62 respectively. The modulation frequency can be between 25 kHz and 100 kHz. Resistors 68, 70, 72, 74 and 76 and capacitors 78 and 80 provide biasing and feedback to the internal amplifiers of IC 62. The pulse-width modulated output of IC 62, controlled by input voltage at pin 1 of the IC, appears alternately at pins 9 and 10 and is applied to the gates of MOSFET devices 82 and 84 across resistors 86 and 88 returned to the power ground. This output on pins 9 and 10 of IC 62 switches MOSFET devices 82 and 84 on and off, producing current through and developing a voltage across resistors 90 and 92 which are connected between the power ground and the gates of MOSFET devices 94 and 96 respectively, and this driving signal is thereby applied to the gates of MOSFET power drivers 94 and 96. By modulating the pulse width of the output from IC 62 in response to feedback as described below, lamp current is controlled.

MOSFET power drivers 94 and 96 are connected in a push-pull configuration comprising a push-pull inverter circuit. The source of MOSFET 94 and the source of MOSFET 96 are connected to the power ground while the drain of MOSFET 94 is connected to one end of the primary winding 98P of transformer 98 and the drain of MOSFET 96 is connected to the other end of the primary winding 98P of transformer 98. With DC voltage applied at the center tap of transformer 98 from choke 58, when MOSFET power driver 94 is turned on and MOSFET power driver 96 is turned off, current flows through one-half of the primary winding 98P of transformer 98. Conversely, when MOSFET power device 96 is turned on and MOSFET power device 94 is turned off, current flows through the other half of the primary winding 98P, producing an alternating magnetic field in the core of transformer 98 at a frequency which has been determined by resistor 64 and capacitor 66 at IC 62. A resistor 124 and capacitor 128 are connected in series between the drain of MOSFET 94 and the power ground and a resistor 126 and capacitor 130 are connected in series between the source of MOSFET 96 and the power ground. Resistors 124 and 126 and capacitors 128 and 130 serve to limit the rate of rise of reverse transient voltage spikes to an acceptable level. The alternating magnetic field produced in the primary 98P of transformer 98 induces a voltage in the secondary 98S which is applied to fluorescent tubes 100 and 102 through optional inductor 104 and capacitor 106 all connected in series. Inductor 104 and capacitor 106 are selected to be series resonant at the frequency of operation and provide a more sinusoidal current waveform to the lamp circuit.

Figure 2A:
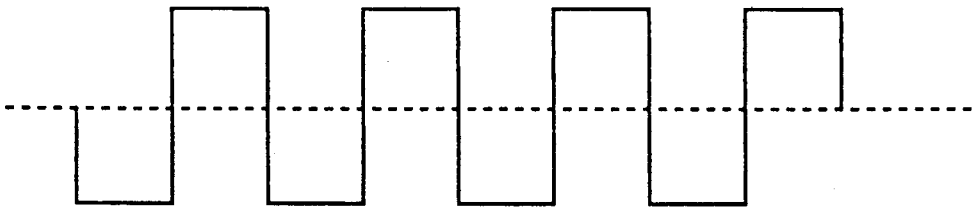
FIGS. 2A–2E are diagrams of waveforms of lamp circuit waveforms at several points and power levels.
Figure 2B:
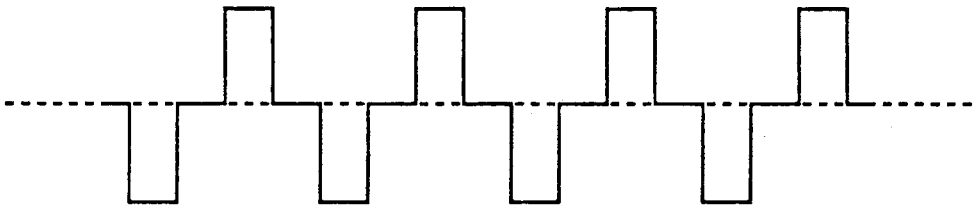
Figure 2C:
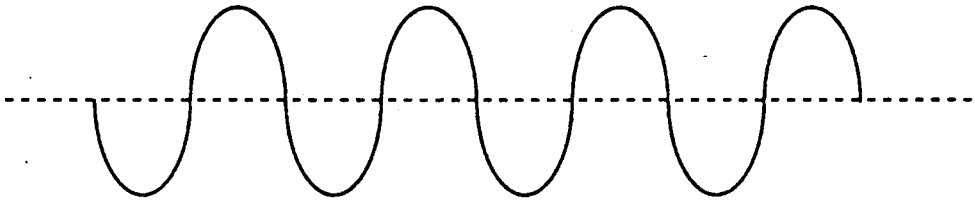

FIG. 2A shows a typical waveform taken at point A, located between the secondary of transformer 98 and inductor 104, when the circuit is operating at full power, and FIG. 2B illustrates a waveform at point A when the circuit is operating at lower power. FIG. 2C depicts a full power waveform at point B, between capacitor 106 and lamp 100, illustrating the effects of inductor 104 and capacitor 106 on the waveform applied to lamps 100 and 102.

Figure 3:
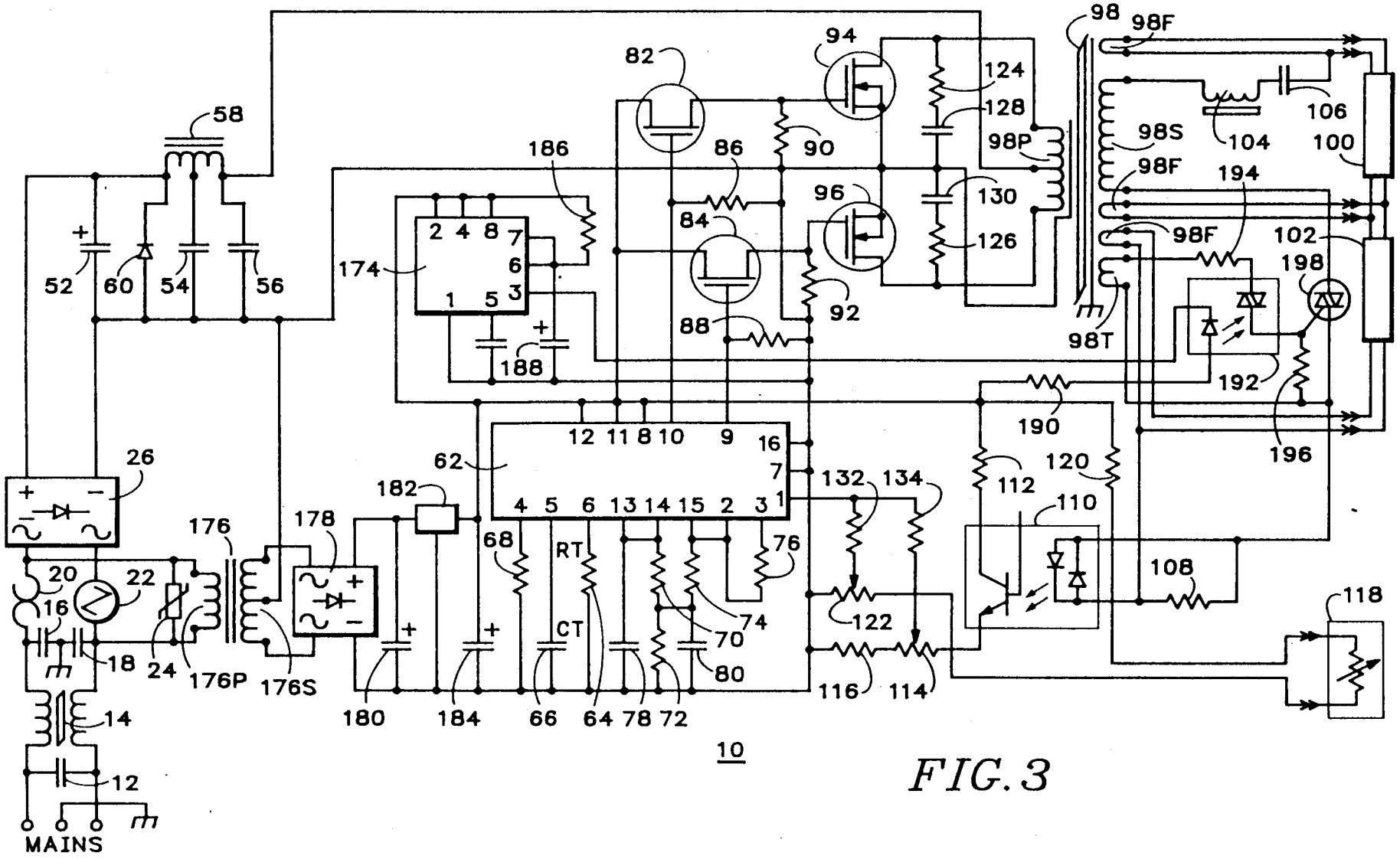
FIG. 3 is a schematic diagram of an alternative embodiment of the present invention incorporating a lamp start delay timer.

Referring again to FIG. 1, capacitor 170 in parallel with lamp 100 aids lamp 102 in starting by providing voltage to lamp 102 which is connected in series with lamp 100 until the lamps have ignited. Transformer 98 isolates lamps 100 and 102 from the primary side of the circuitry and, since the voltage produced by the power factor controlling circuit is lower than the voltage necessary to strike the lamps (380 volts vs. 475 volts), transformer 98 also provides voltage step-up to, for example, 500 volts. While the illustrated embodiment shows cold cathode lamps, hot cathode lamps could be used with the addition of filament windings 98F on transformer 98 as illustrated in FIG. 3 and discussed below, or with a change in transformer 98 for impedance matching, sodium vapor lamps could be utilized.

The return circuit for lamps 100 and 102 is through resistor 108 and then to the lower end of the secondary 98S of transformer 98. The invention includes a lamp current feedback circuit which comprises opto-isolator 110 having an input in parallel with resistor 108 for controlling an output signal through current limit resistor 112, variable resistor 114 and resistor 116 in series with opto-isolator 110 between positive voltage and ground. The output signal of the opto-isolator is proportional to lamp current through lamps 100 and 102. In operation, variable resistor 114 is set to limit the maximum lamp current within lamp ratings.

The circuit additionally includes an ambient light sensor 118 to allow automatic lamp dimming based on the amount of light which may fall on the sensor. (Alternatively, element 118 may comprise a manually adjustable resistor.) The dimming signal is provided to IC 62 via current flowing through current resistor 120 from the positive leg of the power source through sensor 11 in series with variable resistor 122. As the light output from lamps 100 and 102 (as well as any ambient light) changes, the resistance of sensor 118 also changes, thereby causing a change in the current flowing through the sensor. Variable resistor 122 is used to set the minimum light intensity level. Either the manual control or ambient light sensor output and the lamp current control signals are applied to pin 1 of IC 62 through summing resistors 132 and 134 connecting movable taps of resistors 122 and 114 respectively to pin 1 of IC 62. The ambient light control 118 is used to maintain constant illumination levels in the cone of influence of the lamp when other light is available from sunlight or other sources. In operation, an increase in the feedback signal from opto-isolator 110, or from manual control or ambient light sensor 118, causes a corresponding linear decrease in the output pulse width at pins 9 and 10 of IC 62. Consequently, an increase in lamp current through lamps 100 and 102 will cause a corresponding increase in current through the opto-isolator 110, such that IC 62 will reduce the pulse width applied to transistors 82 and 84. Thus, MOSFET power drivers 94 and 96 are turned on for a shorter period, thereby reducing the power supplied to the primary 98P of transformer 98 and consequently reducing the current in the secondary 98S of transformer 98 as well as the current through lamps 100 and 102. A waveform corresponding to FIG. 2B results at winding 98S. Conversely, a decease in lamp current will cause IC 62 to increase the pulse width applied to transistors 82 and 84 thereby turning on MOSFET power drivers 94 and 96 for a longer time duration, increasing the power applied to primary 98P, increasing the current through secondary 98S and lamps 100 and 102, and increasing lamp light output. In this manner, lamp current or brightness are maintained at a desired level.

Figure 2D:
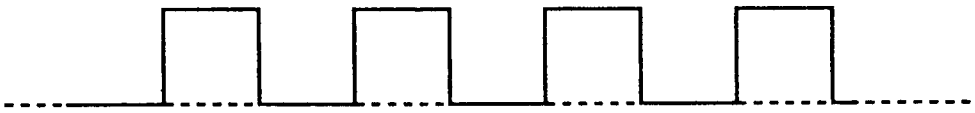
Figure 2E:
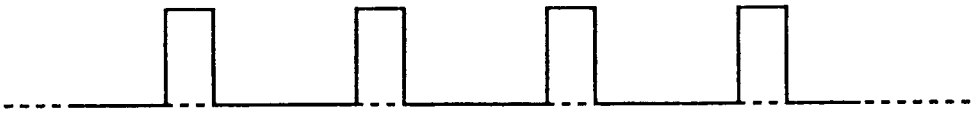

On initial start-up, IC 62 is typically operating at maximum pulse width, illustrated by FIG. 2D, but as soon as the lamps 100 and 102 are energized and current begins to flow in the lamp circuit the feedback voltage at pin 1 of IC 62 increases, thereby reducing the pulse width of the output at pins 9 and 10 of IC 62, as illustrated by FIG. 2E, and thus reducing lamp current through lamps 100 and 102.

The operation of manual controls, the ambient light sensor, and the feedback associated with them produces a system that is relatively immune to brown-out power conditions which can occur when power supply system demands exceed system capacity, thereby reducing the voltage supplied by the power mains and thus causing, for example, in light circuits, less light output. This reduced output causes light dimming or browning for which the condition is named. Since the present invention allows the lamps to draw variable amounts of current, as opposed to fixed current, decreases in supply voltage can be compensated for by increasing lamp current, thus maintaining a more constant light output.

Initialization power for ICs 28 and 62 is suitably provided from an external power source, although an alternative embodiment described in connection with FIG. 3 powers the ICs from the AC power mains. By pressing normally open momentary switch 146, which is connected between the positive terminal of a 24 volt source and the anode of diode 148 further connected to the $V_{CC}$ pins of IC 28 and IC 62, low voltage DC is applied to chips 62 and 28 through diode 148. Soft start capacitor 164 connected between pin 15 of IC 62 and the power ground allows pin 15 of IC 62, which is initially at ground, to charge at a rate depending on the value of capacitor 164. After the circuit is started, sustaining voltage is provided to chips 28 and 62 from secondary winding 98B of transformer 98 through a circuit including rectifier circuit 150 connected to the output of winding 98B, regulator 152 connected in series with the positive output of rectifier circuit 150 and filter capacitors 154 and 156 connected across the positive and negative outputs of rectifier 150 on each side of regulator 152. An embodiment of the present invention further includes an off switch 158, which is a normally open momentary switch connected between the positive 24 volt DC source ad pin 10 of IC 28, i.e., the shutdown pin. Switch 158 is further connected through a resistor 166 to pin 16 of IC 62 and to the negative 24 volt DC source through resistor 168. To turn off the lamp exciter circuit, pressing normally open momentary switch 158 applies DC potential to the shutdown inputs of IC 28 and 62 which then removes drive to transformer 98 thereby turning the system off. Resistors 166 and 168 are current limiting resistors for the shut down operation.

Referring now to FIG. 3, an alternative embodiment of the present invention is illustrated incorporating a preheat delay timer 174. The delay timer allows preheat time for tube filaments of hot cathode lamps before high voltage is applied to the lamps. While the power factor pre-regulation components of FIG. 1 are not illustrated in FIG. 3, these may be incorporated into the circuit of FIG. 3. FIG. 3 also illustrates an alternative method of supplying power to the pulse width modulation circuitry. The alternative power supply method involves the use of a transformer 176 which has its primary 176P coupled to the main power supply and a center tapped secondary 176S with the center tap connected to the negative side of the main DC source, thus providing positive and negative low voltage referenced to the main supply negative line. The secondary voltage from transformer 176 is rectified by rectifier 178 with the output of the rectifier being applied across filter capacitor 180. This output is coupled to a regulator 182, and the output of the regulator is supplied to filter capacitor 184. Thus, rather than requiring an external DC voltage source as in the embodiment of FIG. 1, power to drive the circuitry of IC 62 is derived from the AC mains. This method can also be used to provide power to IC 28.

Delay time circuitry of FIG. 3 comprises delay timer IC 174, with pin 3 thereof connected through the LED of light activated triac 192 and resistor 190 in series to the positive power supply. Transformer secondary winding 98T is connected via current limiting resistor 194 to the triac portion of light activated triac 192 which is returned via resistor 196 to the opposite end of secondary 98T. The junction of triac 192 and resistor 196 is further connected to the gate of a triac 198. Triac 198 is connected between the lower terminal of transformer secondary 98S and the series connection including opto-isolator 110, lamp 102 and lamp 100. The delay timer IC 174 is provided with a resistor 186 connected between pins 6 and 7 and the positive power supply, as well as a capacitor 18B connected between pins 6 and 7 and power supply ground.

In operation, when power is applied to delay timer 174, the timer begins a time delay of length set by resistor 186 and capacitor 188. At the end of the delay cycle during which the lamp filaments are heating, the output of timer 174 at pin 3 switches from high to low, thereby drawing current through resistor 190 which is in series with the light emitting diode in light activated triac 192, thereby turning on triac 192 and allowing current flow through triac 192, current limit resistor 194, transformer secondary winding 98T and resistor 196. Current into the gate of triac 198 turns on triac 198 and allows power to be applied to lamps 100 and 102 for starting the lamps, since triac 198 is in series with transformer secondary 98S and the lamps. Delay timer 174 may comprise, for example, an NE 555 timer manufactured by National Semiconductor Corporation of Santa Clara, California.

The preheat delay timer circuitry essentially operates as a switch which is initially open, thereby preventing current flow through lamps 100 and 102 and transformer secondary 98S while the filaments of lamps 100 and 102 are allowed to heat. Once a sufficient heating time has passed, for example 1.2 seconds, the delay circuitry closes the switch and thereby allows current flow through the lamps thus igniting the lamps. The embodiment of FIG. 3 illustrates the filament windings 98F of transformer 98 which may be used with hot cathode lamps as hereinbefore mentioned, wherein current through transformer primary 98P induces a current in filament windings 98F connected across the lamp filaments.

While preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An exciter circuit comprising:

power source means;

power factor correction means connected to said power source means;

said power factor correction means including constant current source means for producing substantially ripple free DC output;

a transformer having a primary and a secondary;

a load connected to the secondary of said transformer;

inverter means connected to the primary of said transformer for controlling the application of the output of said constant current source means to said primary of said transformer;

a pulse width modulated exciter means, said pulse width modulated exciter means being connected in driving relation to said inverter means to provide high frequency operation therefor;

load current feedback means; and load current control means responsive to said load current feedback means and connected to and controlling said pulse width modulated exciter means for maintaining load current at a desired level.

2. The circuit according to claim 1 wherein said inverter means comprises a pair of transistors connected in push-pull configuration.

3. The circuit according to claim 1 wherein said power factor correction means comprises a power factor correcting pre-regulator circuit which establishes the power factor of the circuit at near unity.

4. The circuit according to claim 1 wherein said load comprises at least one gas discharge lamp.

5. The circuit according to claim 4 further comprising a lamp pre-heat delay timer means, said pre-heat delay timer means delaying application of voltage across said at least one gas discharge lamp while allowing the filaments of said at least one gas discharge lamp to heat.

6. The circuit according to claim 5 wherein said pre-heat delay timer means comprises:

a switch in series with said at least one gas discharge lamp, and a timer circuit, said switch being operable in response to said timer circuit.

7. The exciter circuit according to claim 1 wherein said load current feedback means comprises optically isolated feedback means.

8. The exciter circuit according to claim 6 further comprising photo-responsive means for feeding back a representation of the light output of said at least one gas discharge lamp, said load current control means being responsive to feedback from said photo-responsive means.

9. An exciter circuit comprising:

power source means;

power factor correction means connected to said power source means;

a transformer having a primary and a secondary;

a load connected to the secondary of said transformer;

inverter means connected to the primary of said transformer for controlling the application of power from said power source means via said power factor correction means to said primary of said transformer;

a pulse width modulated exciter means, said pulse width modulated exciter means being connected in driving relation to said inverter means to provide high frequency operation therefor;

load current feedback means wherein said load current feedback means comprises an opto-isolator having an input connected in series with the load circuit; and load current control means responsive to said load current feedback means and connected to and controlling said pulse width modulated exciter means for maintaining load current at a desired level wherein said opto-isolator has an output connected in operative relationship to said load current control means.

10. An exciter circuit comprising:

power source means;

power factor correction means connected to said power source means wherein said power factor correction means comprises a power factor correcting pre-regulator circuit which establishes the power factor of the circuit at near unity and wherein the frequency of operation of said power factor correction means is on the order of 100 kHz;

a transformer having a primary and a secondary;

a load connected to the secondary of said transformer;

inverter means connected to the primary of said transformer for controlling the application of power from said power source means via said power factor correction means to said primary of said transformer;

a pulse width modulated exciter means, said pulse width modulated exciter means being connected in driving relation to said inverter means to provide high frequency operation therefor;

load current feedback means; and load current control means responsive to said load current feedback means and connected to and controlling said pulse width modulated exciter means for maintaining load current at a desired level.

11. An exciter circuit comprising:

power source means;

power factor correction means connected to said power source means;

a transformer having a primary and a secondary;

a load connected to the secondary of said transformer wherein said load comprises at least one gas discharge lamp;

inverter means connected to the primary of said transformer for controlling the application of power from said power source means via said power factor correction means to said primary of said transformer;

a pulse width modulated exciter means, said pulse width modulated exciter means being connected in driving relation to said inverter means to provide high frequency operation therefor;

load current feedback means wherein said load current feedback means comprises an opto-isolator for load current feedback and further comprises light sensing means responsive to the light output from said at least one gas discharge lamp; and load current control means responsive to said load current feedback means and connected to and controlling said pulse width modulated exciter means for maintaining load current at a desired level.

12. A lamp exciter circuit feedback means for controlling current in one or more lamps comprising:

feedback control means;

an opto-isolator, the output of said opto-isolator being connected to said feedback control means, the input of said opto-isolator being connected in series with said one or more lamps for feeding back the level of current flowing through said one or more lamps; and photo-responsive means for feeding back a representation of the light output of said one or more lamps, said feedback control means being responsive to feedback from said opto-isolator and said photo-responsive means for altering current flowing through said one or more lamps in response to the feedback.

* * * * *

UNITED STATES PATENT AND TRADEMARK OFFICE

CERTIFICATE OF CORRECTION

PATENT NO. : 5,030,887

DATED : July 9, 1991

INVENTOR(S) : John E. Guisinger

It is certified that error appears in the above-identified patent and that said Letters Patent is hereby corrected as shown below:

Column 5, line 68, Column 6, line 1, "sensor 11" should be --sensor 118--.

Column 7, line 62, "capacitor 18B" should be --capacitor 188--.

Column 9, line 16, "claim 6" should be --claim 4--.

Signed and Sealed this

Ninth Day of March, 1993

*Attest:*

STEPHEN G. KUNIN

*Attesting Officer*

*Acting Commissioner of Patents and Trademarks*